United States Patent [19]

Endter et al.

[11] Patent Number: 4,619,574

[45] Date of Patent: Oct. 28, 1986

[54] LOADING EQUIPMENT FOR MANIPULATING TUBES IN UPSETTING PRESSES

[75] Inventors: Horst Endter, Langenfeld; Herbert Suther, Dusseldorf, both of Fed. Rep. of Germany

[73] Assignee: SMS Hasenclever Maschinenfabrik GmbH, Dusseldorf, Fed. Rep. of Germany

[21] Appl. No.: 546,910

[22] Filed: Oct. 31, 1983

[30] Foreign Application Priority Data

Nov. 4, 1982 [DE] Fed. Rep. of Germany ..... 3240689

[51] Int. Cl.[4] ..... B66F 9/00

[52] U.S. Cl. ..... 414/226; 72/405; 414/748; 414/753

[58] Field of Search ..... 414/222, 226, 744 A, 414/745, 748, 753; 901/6, 7, 8; 72/405, 421; 198/486, 468.2, 468.3

[56] References Cited

U.S. PATENT DOCUMENTS

| | | | |
|---|---|---|---|
| 3,834,213 | 9/1974 | Henzler et al. | 72/405 |
| 4,186,589 | 2/1980 | Criblez | 72/405 |
| 4,255,075 | 3/1981 | Babbitt | 414/222 |
| 4,388,039 | 6/1983 | Schwarze | 414/748 |

FOREIGN PATENT DOCUMENTS

| | | |
|---|---|---|
| 1075924 | 8/1960 | Fed. Rep. of Germany . |
| 1096167 | 7/1961 | Fed. Rep. of Germany . |

*Primary Examiner*—Robert J. Spar
*Assistant Examiner*—Donald W. Underwood
*Attorney, Agent, or Firm*—Holman & Stern

[57] ABSTRACT

In a tube-upsetting press, of the kind having a vertically split die with vertically spaced shaping faces for successive setting operations, metal tubes to be upset are handled by sets of grippers which move cyclically along a closed path perpendicular to the axes of the tubes and the die and respective grippers move cyclically towards and away from the die, these movements being so synchronized that successive tubes are gripped, moved into line with one shaping face of the die and advanced thereinto by a first gripper of the set, shifted to the next shaping face by another gripper of the set, and withdrawn from the die by a further gripper of the set after upsetting. Fixed retaining grippers hold the tubes during upsetting, and oscillating transfer grippers move the tubes laterally from a supply table into alignment with the first die-feeding grippers of the set. The drive train for the several sets of grippers is described.

13 Claims, 19 Drawing Figures

LOADING EQUIPMENT FOR MANIPULATING TUBES IN UPSETTING PRESSES

BACKGROUND OF THE INVENTION

The upsetting of the thickened ends of tubes (which term includes pipes) is carried out in upsetting presses, and usually requires two, occasionally one or more than two (three or four) operations. Upsetting presses are therefore provided with vertically divided dies having to superposed shaping faces. The dies consist of a front pair of jaws for clamping the tubes and of a rear pair of jaws comprising the shaping faces involved in the upsetting operation. The two operations of preliminary and final upsetting that are usually carried out takes place one after the other in a single heat in the superposed shaping faces of the die. The efficiency of the upsetting operation depends to a considerable extent upon the mode of operation and therefore upon the construction of the loading equipment with which the tubes are manipulated. Thus, in the case of vertically divided dies, it is necessary to bring the tubes exactly into alignment on the middles of the shaping faces before closing the dies and to hold them there until the dies are closed, so as to avoid straining of, and damage to, the tubes.

Very accurate axial positioning of the ends of the tubes in the dies is also necessary, firstly so as to enclose, between the shaping faces, a sufficient amount of material for the upsetting operation, and secondly so as to prevent upsetting defects (dimensional deviations and the formation of folds, particularly in the case of internally thickened tube-ends), for which purpose it is particularly necessary for the transition zone between the hot tube-end and the cold tube to be accurately axially positioned between the shaping faces of the die. In order to limit the flow of heat from the heated tube-end to the cold tube and to keep the transition zone within narrow bounds, considerable importance attaches to a rapid transfer of the tubes from the heating installation to the precise positions for upsetting. The creation of noise during manipulation of the tubes must nevertheless be borne in mind and limited to a low level. Thus, there arises the problem of providing tube-loading equipment that operates accurately, rapidly and with little noise.

Loading equipment previously used for manipulating tubes on upsetting presses of the stated kind consists of a roller bed comprising V-shaped rollers as the means for receiving the tubes to be manipulated, these rollers being mounted on an upwardly and downwardly movable bridge and having reversible drives. The roller bed is loaded from a support grid, which bridges the space between the induction coils for heating the tube ends and the upsetting press and which slopes towards the press. Each tube resting on the roller bed is aligned with the middle of the shaping faces of the die by vertical displacement of the bridge and is moved, by the rollers, axially into and out of the zone of the dies. In operation, these loading systems are too slow, too inaccurate and, in addition, relatively noisy. A further disadvantage resides in the fact that a fresh tube can be manipulated in the upsetting press only when the preceding tube has been removed from the press and the upwardly and downwardly displaceable bridge has been returned to its upper position. Thus, it is not possible to manipulate a second tube in the upsetting press with the result that it is impossible to carry out work simultaneously in two superposed sets of shaping faces of the dies. This loading equipment does not therefore solve the problem whose solution forms the object of the present invention.

SUMMARY OF THE INVENTION

The object with which the invention is concerned is achieved in that there are provided, as a means for accommodating the tubes, tongs, at least two of which are arranged along the length of the tubes and which are superposed in sets of three in a vertical plane in the vertical space between the shaping faces and are displaceable simultaneously and unidirectionally transversely of the axes of the tubes in a closed path, and the highest and lowest points of the path lie vertically one above the other at a distance corresponding to that separating the shaping faces in the dies, the movement-imparting drive briefly interrupting the movement cycle each time that the highest and lowest points of the path are reached, and the lower dwell position of the upper tongs having an axial tube position congruous with a tube clamped in the upper shaping face of each die; in that the upper and lower of the three tongs are furthermore displaceable opposite each other at right angles to the path forming a normal plane, the displacement being toward and away from the dies over distances greater than the axial length of the dies; and in that, during the upwardly directed part of the movement cycle, the tongs are brought into the open position and during the downwardly directed part of the movement cycle they are brought into the closed position.

The use of movable tongs in loading systems for manipulating workpieces on forging machines is known, but the present invention is based on the overall combination of the above-mentioned features and in this combination, enables the stated object to be achieved.

The tubes clamped in the shaping faces of the dies when the die-halves are closed are satisfactorily held in position if the tubes are short. A simple support would suffice for longer tubes. However, in accordance with a further feature of the invention and for the purpose of securing the tubes at all times, especially against unwanted disadvantageous axial displacement, there are provided, in association with the tongs (conveyor tongs) moved along the path, stationary tongs (retaining tongs—at least two along the length of the tube), which tongs are aligned with the mutually corresponding lower dwell positions of the upper conveyor tongs and the upper dwell positions of the lower conveyor tongs.

In their top position, the upper of the movable tongs (conveyor tongs) superimposed in sets of three receive the tubes, each heated at one of its ends, from a ready position which, in the known manner, can be located at the end of an inclined support grid. Movement over the support grid may lead to a change in the axial position of the tubes and may make it necessary to readjust the tubes axially in the ready position. Furthermore, the noise that develops when the tubes roll down the support grid is undesirable. To avoid these disadvantages and in accordance with a further feature of the invention, there are associated with the conveyor tongs, transfer tongs which are mounted on swivel levers and one of the end positions of which has an axial tube position congruous with the upper conveyor tongs in the top dwell position, while the swivel range of said transfer tongs bridges the distance to a tube-receiving table at the side of the upsetting press, this table accommodating the tubes which emerge from the heating installation of which are released therefrom over a short distance.

It is advantageous if, in accordance with a further feature of the invention, the conveyor tongs travel along a square movement path in which the vertical sections thereof correspond to the vertical distance between the shaping faces in the dies and the points at which the movement cycle is interrupted (dwell positions of the conveyor tongs) are provided at the middle of the horizontal portions of the path, since this facilitates the placing of the tubes in, and their removal from, the shaping faces of the dies as well as their placement in and removal from the stationary retaining tongs.

The square path of movement, in an advantageous arrangement, is achieved by mounting the conveyor tongs on lifting beams which, in known manner, form the couplers of two parallel linkages designed as wheel crank drives, in which arrangement an auxiliary crank, mounted on a main crank, executes, by way of the wheel drive, a number of revolutions which is four times that of the main crank, and the radius of the auxiliary crank is approximately equal to half the height of the arc of a quarter-circle segment in the circle of the main crank.

In accordance with a further feature of the invention, the necessary interruption of the movement cycle at the top and lower point of the path of the conveyor tongs is achieved by means such as a stepping gear fitted between a variable-speed drive, and the drive imparting movement, for which stepping gear the invention provides, as an advantageous solution, a cycloidal gear, known per se, which is formed by combining a wheel crank drive with a crank guide, an auxiliary crank, mounted in the main crank of the wheel crank drive, executing, by way of the wheel drive, twice the number of revolutions as are executed by the main crank, while the radius of the auxiliary crank is approximately one-third of that of the main crank, and the auxiliary crank engages in a guide lever mounted coaxially with the main crank.

As regards the design of a gear for achieving a square path of movement and for providing a stepped gear on equipment for manipulating workpieces on forging presses, reference is made to German Pat. No. 28 06 987 in which such gears—as mentioned above—have been disclosed.

In accordance with a further feature of the invention and for the purpose of providing a particularly advantageous form of the gear for the additional movement of the upper tongs in the opposite direction to the lower tongs at right angles to the path of the common movement of the tongs that takes the form of a normal plane, the upper and lower conveyor tongs are mounted on upper and lower slides, the upper slides being movable in the opposite direction to the lower slides at right angles to the normal plane on lifting beams and being driven by the counter-moving strands of cables or chain drives or by counter-running rack-and-pinion drives, and each cable, chain and/or pinion drive is powered, by way of a sectorial rocker arm, by a crank drive having an adjustable stroke and adjustable reversal points.

As already mentioned, rapid transfer of the tubes is of considerable importance. This requirement is met by various of the above-described features of the invention and further improvement is achieved if, in accordance with yet another feature of the invention, downstream of the stepping gear, there is provided a gear branch system with branches having a 1:1 reduction ratio, to the lifting beam drives for the main movement of the conveyor tongs, to the slide drives for the transverse movement of the upper and lower conveyor tongs, and to the swivel drives for the transfer tongs, so that all of the movements of the tongs derive form a single drive. The timed execution of all the movements of the tongs is thus ensured, and costly follow-up control means requiring safety times are not necessary.

Special measures have to be taken so as to enable the tubes to be moved, without loss of time, by the transfer tongs from the receiving table to the rear of the heating installation. Therefore, in accordance with a still further feature of the invention, the swivel levers of the transfer tongs form the couplers of double rocker four-bar linkages, the tongs are arranged on extensions of the couplers and the drive rocker arms are designed as angled levers, their second arms form the rocker arms of crank rocker four-bar linkages with driven cranks. Thus it is possible to achieve, for the movement of the tongs, a coupling curve which, in the zone of the receiving table for the tubes, extends parallel to the surface of the table so that the tubes can be deposited on the table and the transfer tongs can be set in motion without any particularly precise timing and without the need for safety times.

BRIEF DESCRIPTION OF THE DRAWINGS

An embodiment of the invention is illustrated by way of example in the accompanying drawings, in which:

FIG. 5 illustrates the construction of the stepping gear, in connection with which FIG. 8 illustrates the construction of the gear for providing the main movement transversely of the axis of the tube, in connection with which

DESCRIPTION OF THE PREFERRED EMBODIMENT

Figure 1:
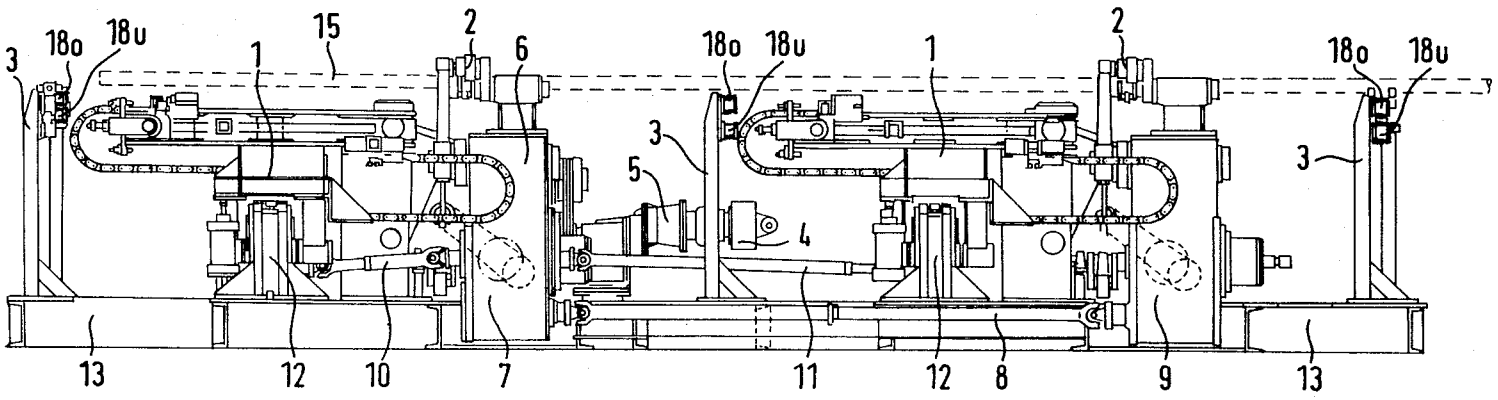
FIG. 1 shows an overall view of the front of the loading equipment.
Figure 2A:
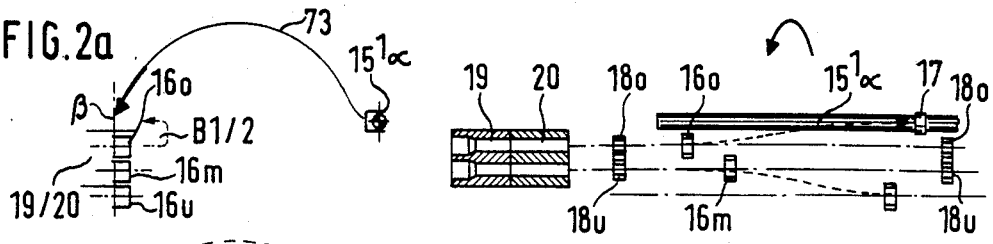
FIGS. 2*a* to 2*g* are diagrammatic front and side views respectively illustrating seven steps in the loading of a tube.
Figure 2B:
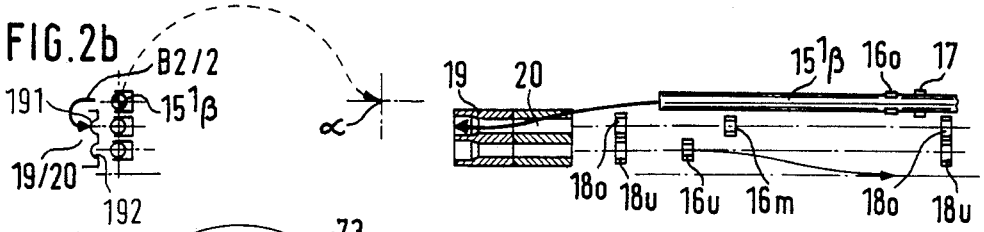
Figure 2C:
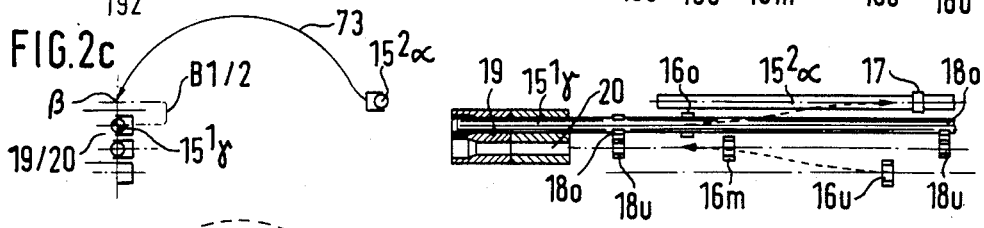
Figure 2D:
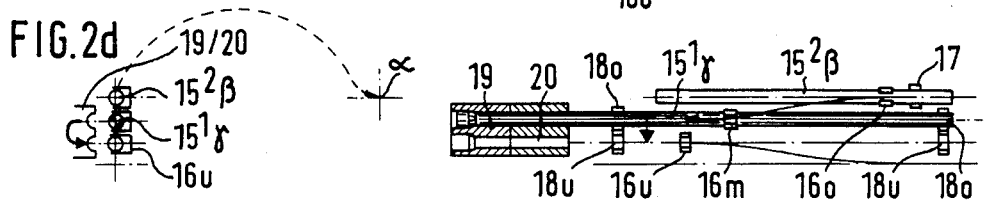
Figure 2E:
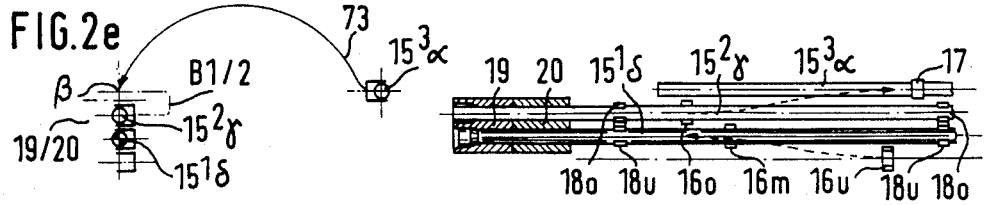
Figure 2F:
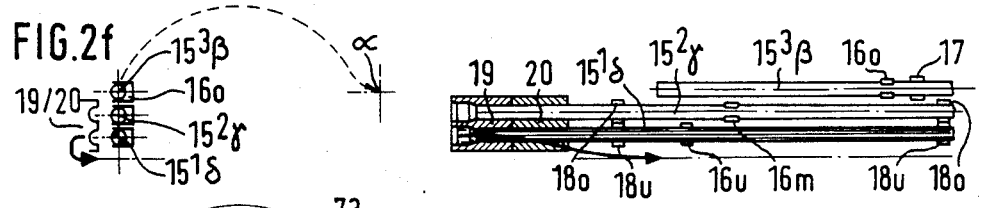
Figure 2G:
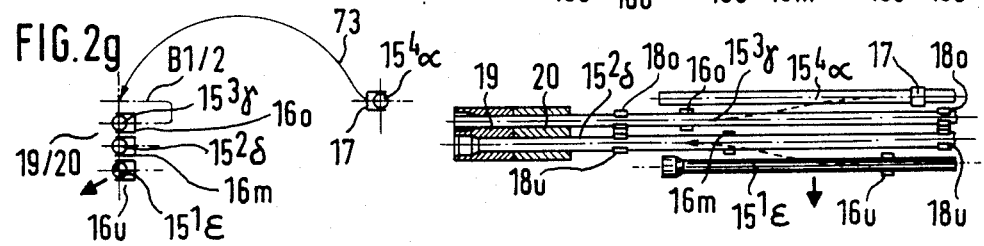

As shown in FIG. 1, the loading equipment is made up of two conveyor tong mechanisms 1, two lateral transfer tong mechanisms 2, and three retaining tong mechanisms 3, which are in each case similar to each other. The loading equipment is powered by a motor 4 which drives an intermittent-motion transmission in the form of a stepping gear assembly 6 by way of a variable speed transmission in the form of a steplessly variable gear 5. Combined with the stepping gear assembly 6 is a branching gear assembly 7 forming a drive distributing transmission, which drives a second branching gear assembly 9 by way of a universal-joint shaft 8. Leading off from the branching gear assembly 7 are two power take-offs, which through universal-joint shafts 10 and 11, each power a feed drive 12 which serves to drive the conveyor tong mechanisms 1. The components are contained in a main frame 13 to form a single unit.

The diagrammatic drawing in FIG. 2 shows the mode of operation of the loading equipment in stages a to g. The numeral 15 designates the manipulated tubes, 15$^1$ designating a first, 15$^2$ a second, 15$^3$ a third and 15$^4$ a fourth tube of a series, the different positions of the tubes in the sequence being designated by $\alpha$,$\beta$, $\gamma$, $\delta$ and $\epsilon$. At least two sets of conveyor tongs 16 are disposed along the length of the tube, each comprising upper tongs 16*o*, middle tongs 16*m* and lower tongs 16*u* in line vertically at a spacing equal to that of the upper and lower shaping surfaces 191, 192 of a vertically split die 19,20 comprising a front pair of jaws 20 for clamping the tubes, and a rear pair of jaws 19 provided with the shaping surfaces. The numeral 17 designates one of at least two transfer tongs disposed along the length of each tube, and 18*o*/18*u* designate pairs of retaining tongs. The tongs are provided with respective operating means 78 for opening and closing the tongs. In FIG. 2*a*, 15$^1\alpha$ indicates the position of a first tube 15 in the location $\alpha$, i.e. the location of the tubes on a receiving table after they have left the heating installation. Transfer tongs 17 grip the tube 15$^1$ and carry it laterally into the location $\beta$ above the die. At the same time, the conveyor tongs 160*o*, *m* and *u* move up along the first half B 1/2 of their path of movement which is a closed vertical loop, and into their top position in which the upper conveyor tongs 16*o* are aligned with the tube location $\beta$ as can be seen from FIG. 2*b*. The transfer tongs 17 as well as the conveyor tongs 16 dwell for a short period in this location $\beta$ and the transfer tongs 7 open, while at the same time the conveyor tongs 16*o* close. The conveyor tongs 16 with the tube 15$^1$, gripped by the upper conveyor tongs 16*o*, then move along the descending second half B 2/2 of their path of movement and into their bottom position, in which the tongs 16*o* are in alignment with the upper retaining tongs 18*o* and an upper shaping face 19*l* of the die 19/20. The vertically divided die is in the open position at this stage, so that the tube 15$^1$ can move axially into the gap between the die-halves. At the same time as the conveyor tongs 16 are lowered, the upper tongs 16*o* are moved towards the die 19/20 so that the end of the tube 15$^1$ enters the upper shaping face over the distance necessary for upsetting the end of the tube. While this is happening, the transfer tongs 17 swing back into their initial position. The conveyor tongs again dwell in this lower position for a short time, during which the retaining tongs 18 and the halves of the die 19/20 close, and the conveyor tongs 16 open, the position $\gamma$, illustrated in FIG. 2*c*, being reached. While the first upsetting operation is being carried out in the die 19/20, with the tube 15$^1$ clamped between the jaws 20 of the die 19/20 and being supported by the retaining tongs 18, the conveyor tongs 16 again move along the first half B 1/2 of their path of movement into their top position, the upper conveyor tongs 16*o* again moving away from the die 19/20 into the location for receiving a next tube 15$^2$, which is at the same time swung by the transfer tongs 17 from the location $\alpha$ into the location $\beta$. The conveyor tongs 16 and the transfer tongs 17 again dwell for a short time in this position, the conveyor tongs 16 close so that the middle tongs 16*m* grip the tube 15$^1$, and the transfer tongs 17 as well as the retaining tongs 18 open. As shown in FIG. 2*d*, the die 19/20 is then opened, the transfer tongs 17 swing back into their original position, and the conveyor tongs 16 move back into their bottom position along the second half B 2/2 of their path of movement, the tongs 16*m* bringing the tube 15$^1$ from the upper shaping face as in position $\gamma$ into the lower shaping face as in position $\delta$, and the tongs 16*o* bringing the tube 15$^2$, by simultaneous axial movement, into the upper shaping face of the die 19/20 as in the location $\gamma$. Then (see FIG. 2*e*) the die 19/20 is closed. The tubes 15$^1$ and 15$^2$ are gripped by the clamping jaws 20 of the die and upsetting of the tube 15$^1$ is completed in the shaping faces 192 of part 19 of the die, and the tube 15$^2$ undergoes preliminary upsetting in the shaping faces 191. At the same time, the transfer tongs swing a further tube 15$^3$ from the location $\alpha$ into the location $\beta$, and the conveyor tongs 16 move over the first half B 1/2 of the path of movement into the top position where they dwell for a short period, during which the conveyor tongs 16 are closed and the transfer tongs 17 and the retaining tongs 18 are opened. Then, as shown in FIG. 2*f*, the die 19/20 is opened, the conveyor tongs 16 move along the second half B 2/2 of their path of movement and again into the bottom position, and the transfer tongs 17 swing back into their original position corresponding to the tube location $\alpha$. As this is happening, the tube 15$^3$ is moved from the location $\beta$ and into the upper shaping face as in location $\gamma$, the tube 15$^2$ is moved from the upper to the lower shaping face as in location $\delta$, and the tube 15$^1$, by simultaneous axial movement of the lower conveyor tongs 16*u*, is moved from the lower shaping face and into the location $\epsilon$. After the die 19/20 has been closed again—FIG. 2*g* shows this—the tube 15$^3$ undergoes preliminary upsetting in the upper shaping face, and upsetting of the tube 15$^2$ is completed in the lower shaping face. The retaining tongs are closed, the transfer tongs bring a fresh tube 15$^4$ from the $\gamma$ location to the $\beta$ location, the conveyor tongs 16 are opened and again move along the first half B 1/2 of the path of movement and into their top position. The completely upset tube 15$^1$ is released and is carried away by means not illustrated. In the case of tubes having large outside dimensions and/or a great wall-thickness and which do not permit the preliminary and final upsetting of two tubes in unison, the work cycle can be controlled in such manner that only during each second complete motional cycle of the conveyor tongs 16, do the transfer tongs 17 move a fresh tube and therefore only each second tube location is occupied each time. This can happen in a very simple manner by blocking the movement of tubes into the location $\alpha$ during each second cycle and by reducing the work cycle of the heating installation accordingly.

Figure 3:
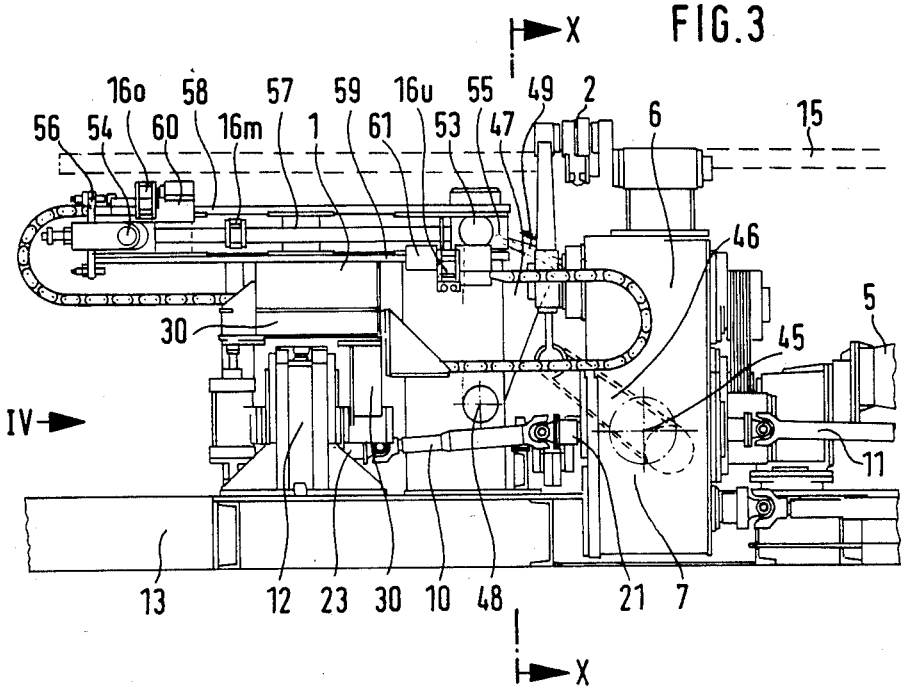
FIG. 3 shows, on a larger scale, a portion of FIG. 1.
Figure 13:
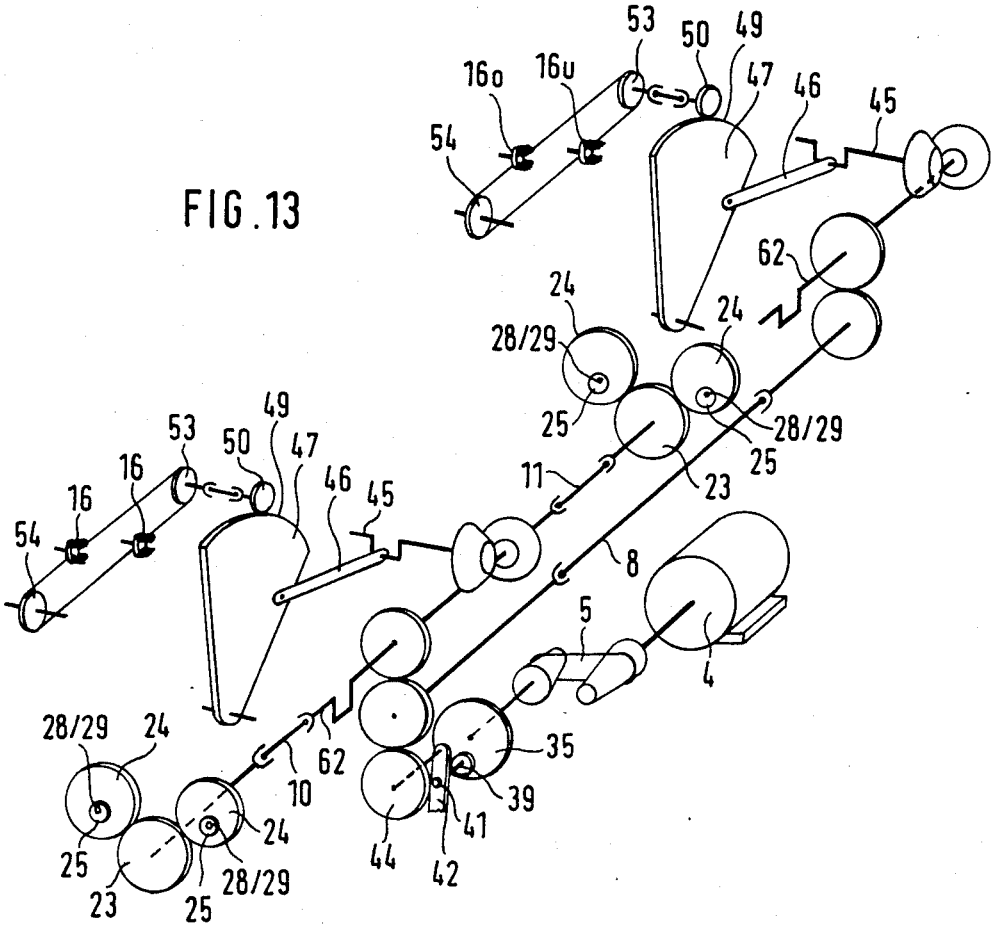
FIG. 13 shows an overall perspective view of the driving arrangement.

Details of the construction of the loading equipment are shown in FIGS. 3 and 13.

Figure 4:
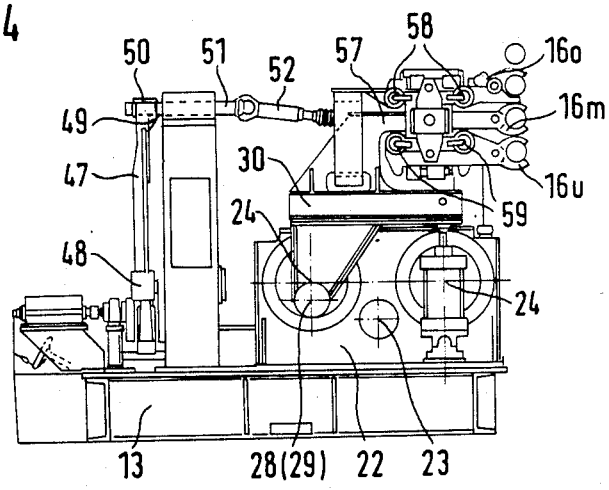
FIG. 4 shows a side view of the FIG. 3 material as seen in the direction indicated by the arrow IV.
Figure 8:
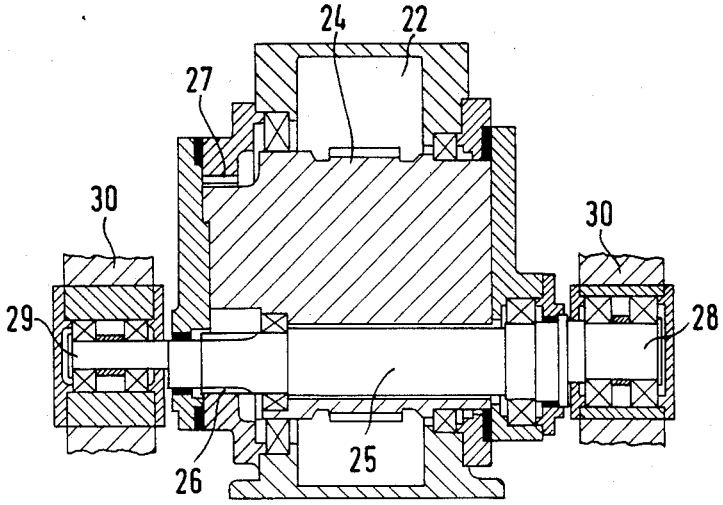
Figure 9:
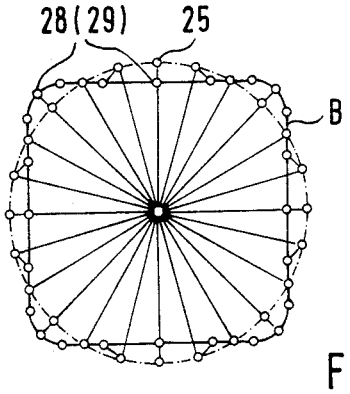
FIG. 9 illustrates the kinematic principle.
Figure 10:
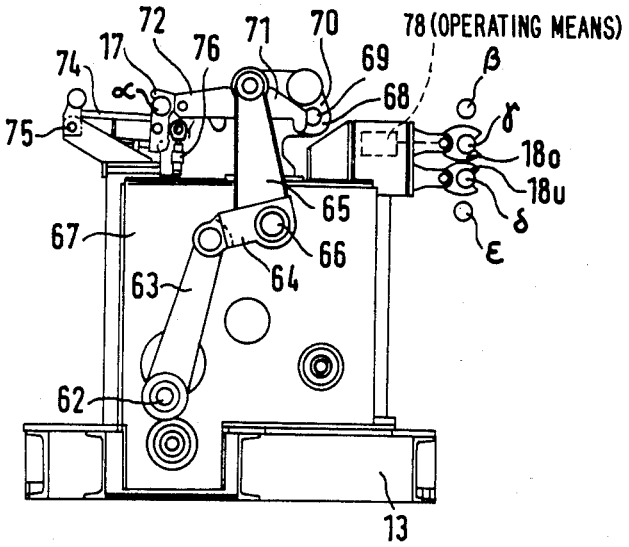
FIGS. 10 and 11 are side views from the plane designated X—X in FIG. 3, two operating positions of the transfer tongs being illustrated, in which connection
Figure 11:
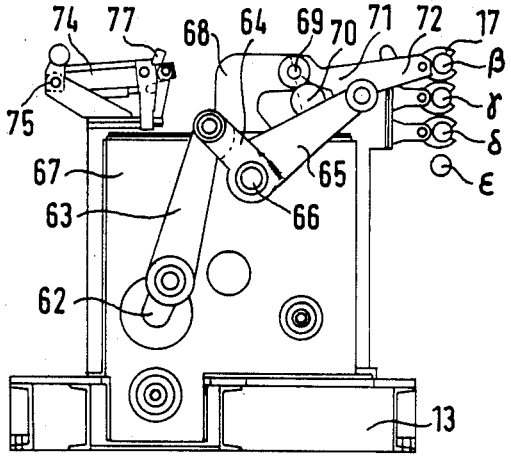

The stepping gear assembly 6 is driven by the motor 4 (see FIG. 1) through a steplessly variable gear assembly 5, and by means of the gear assembly 5 the work cycle of the loading equipment can be adapted to suit the work cycle of the installation for heating the ends of the tubes and that of the upsetting press. The main component of the loading equipment is constituted by the conveyor tong mechanisms 1, one of which is shown on a larger scale in FIGS. 3 and 4. The drive 12 of the conveyor tong mechanism 1 is driven from the branch 21 of the branching gear assembly 7 by way of a universal-joint shaft 10. In the drive 12 (FIG. 8) a shaft driven by shaft 10 carries an intermediate gear 23 which drives two gear-wheels 24. Each of these gear-wheels 24, together with a shaft 25 eccentrically and rotatably mounted therein, forms a main crank. Shaft 25 is provided with a pinion 26, which rolls on an internally toothed rim 27 secured in a housing 22. Since the internally toothed rim 27 has four times as many teeth as the pinion 26, the shaft 25 rotates four times for each revolution of the gear-wheel 24. At both of its ends the shaft 25 carries eccentric crank pins 28, 29, the eccentricity of which is such that, during rotation of the gear-wheel 24, the centre of the eccentric pins 28, 29 move along a path B as represented in FIG. 9. The eccentricity corresponds to approximately half the height of the arc of a quarter-circle segment of the rotational circle of the shaft 25, so that the path B corresponds to a square having slightly rounded corners. Mounted on the eccentric pins 28 and 29 are lifting beams 30, which carry the conveyor tongs 16 and move them along the path B and transversely of the longitudinal axis of each of the tubes 15 that are to be manipulated. The path B defines a plane perpendicular to the tube axis and feed direction.

Figure 5:
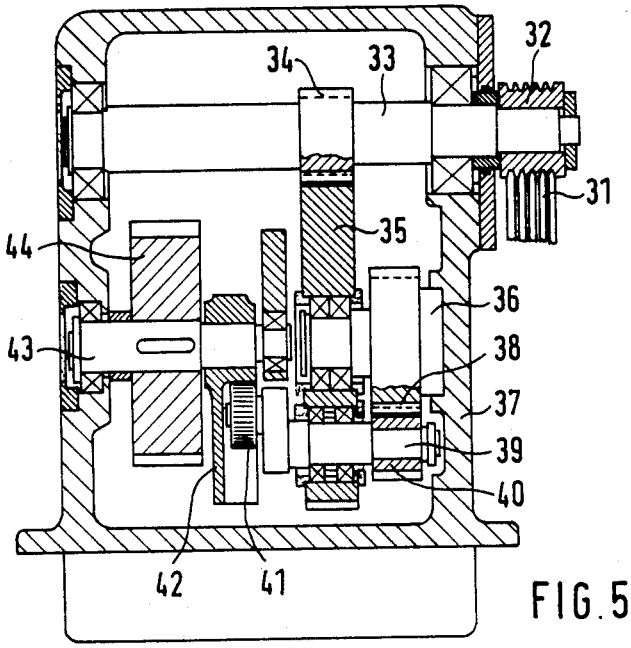
Figure 6:
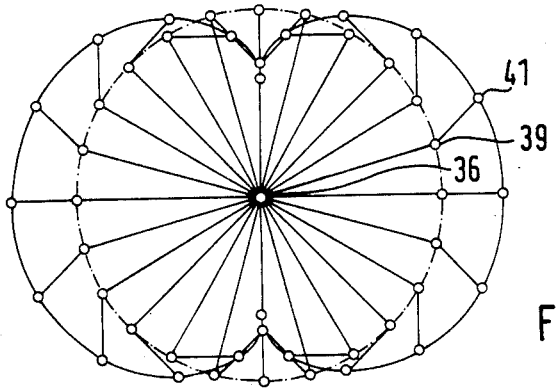
FIG. 6 illustrates the kinematic principle.
Figure 7:
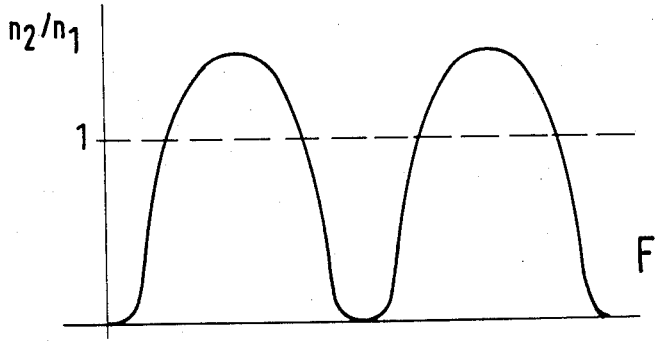
FIG. 7 shows the speed ratio produced by the stepping gear.

As provided for in the mode of operation described with reference to FIGS. 2*a* to *g*, the path of movement B is divided into two halves B 1/2 and B 2/2, and between the two halves the movement is interrupted for a short while to permit closing and opening of tongs, when these and the tubes are stationary, in the respective locations $\alpha$, $\beta$, $\gamma$, $\delta$ and $\epsilon$. This interruption of movement is achieved by means of the stepping gear assembly 6 which is provided between the drive 4 and the branching gear assemblies 7 and 9. This stepping gear assembly will be described in detail by reference to FIGS. 5 to 7. The stepping gear assembly is powered by the motor 4 by way of the steplessly variable gear assembly 5, and the output shaft of which drives a shaft 33 at the input side of the stepping gear assembly 6 by means of a V-belt 31 and a V-belt pulley 32. A pinion 34, mounted on the shaft 33, meshes with a gear-wheel 35 which is mounted to rotate on a bearing pin 36. The bearing pin 36 is secured, but does not rotate, in a housing 37 and carries a toothed rim 38 which does not rotate relatively thereto. A crankshaft 39 constituting an auxilliary crank is rotatable in the gear-wheel 35 and rotates with the pinion 40 which is mounted thereon and rolls on the fixed toothed rim 38. The pinion 40 has half as many teeth as the toothed rim 38, so the crankshaft 39 turns twice for each revolution of the gear-wheel 35. The crankshaft 39 carries a crank pin 41 on which is mounted a roller and which is off-centre to an extent approximately equal to one-third of the eccentricity of the crankshaft 39 in the gear-wheel 35; by way of the crank pin 41, the crankshaft 39 engages in a groove formed in a drag lever 42, which is mounted on a shaft 43, coaxial with the bearing pin 36, so that the shaft 43 is intermittently rotated with its output gear 44. FIG. 6 shows each position of the crank pin 41 achieved in dependence on the rotation of the gear-wheel 35, whereas FIG. 7 shows the speed ratio $n_1/n_2$ between the gear-wheel 35 to the rear of the input and the shaft 43 at the output of the stepping gear assembly 6, which ratio is obtained by the stepping gear assembly 6 under the stated conditions. It will be seen that the stepping gear assembly, during complete revolution of the output wheel 44 of the stepping gear assembly 6, interpolates, after each half-revolution, a dwell which is equal to approximately one-tenth of the total time required for a revolution.

A crankshaft 45 is driven by the branching gear assembly 7 by power take-off bevel gears shown in FIG. 13 at the same speed as the shaft 21, and the crankshaft 45 moves, by way of a connecting rod 46, a sectorial rocker arm 47 which is swivellably mounted at 48. This sectorial rocker arm 47 is provided, along its arc, with a toothed portion 49 which drives alternately in opposite directions of rotation a pinion 50 mounted on a shaft 51. The shaft 51 in turn rotates a capstan drum 53 through a univeral-joint shaft 52, which drum imparts movement to an endless cable guided over a jockey roller 54. The bearing 55 for the capstan drum 53 and the crossbar 56, supporting the jockey roller 54, are interconnected by a bridge 57 which is a constituent part of the lifting beam 30 and also carries the middle conveyor tongs 16*m* of the three tongs 16 as well as two guides 58 and 59 for an upper slide 60, which carries the upper conveyor tongs 16*o*, and for a lower slide 61 which carries the lower conveyor tongs 16*u*.

The slide 60 is secured to the upper strand of the cable between the capstan drum 53 and the jockey roller 54 and the slide 61 is secured to the lower strand of this cable; the two slides 60 and 61 secured to the strands of the cable are moved in a uniform manner in opposite directions to each other, and when a tube 15 is lowered to the middle of the upper shaping face of the die 19/20, the upper conveyor tongs 16*o* move the tube 15 axially into the die 19/20, and when a tube 15 is lowered from the middle of the lower shaping face of the die 19/20, the lower tongs 16*u* remove the tube 15 from the die 19/20 also in the axial direction. By adjusting the effective lengths of the radius on the crankshaft 45 and the length of the connecting rod 46, the end position of the tubes 15 in the die 19/20 and the distance over which the tubes 15 are axially displaced can be varied.

As in the case of the branching gear assembly 7, the branching gear assembly 9 also has a branch for driving the second conveyor tong mechanism 1.

Figure 12:
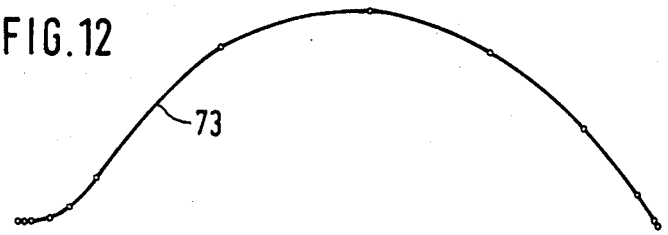
FIG. 12 shows the coupling curve along which the transfer tongs are moved.

A second branch of the branching gear assembly 7, likewise present on the branching gear assembly 9, is constituted by a crankshaft 62, which is driven at the same speed of revolution as the shaft 21 and the crankshaft 45 and which, by way of a coupler 63, rocks a bell-crank lever comprising two arms 64 and 65. The lever 64/65 is mounted on a pivot 66 which is flanged on to the housing 67 of the stepping gear assembly 6 and the branching gear assembly 7. The pivot 66 and the bearing for the crankshaft 62 form the fixed hinges on the housing 67, which serves as the fixed link, of a four-bar linkage forming a crank rocker and consisting of the crank 62, the coupler 63 and the arm 64 of the bell crank lever. The arm 65 of the lever, which executes a swing movement, constitutes a drive rocker in a further four bar-linkage which comprises the pivot 66 and a second pivot 69 carried by a bracket 68 on the housing 67, as the fixed hinges, a short rocker link or follower link 70 and a coupler 71; an extension 72 of the coupler 71 carries transfer tongs 17 forming part of the transfer-tong mechanism 2. The transfer tongs 17 of the second transfer-tong mechanism 2 are moved in a similar way by means of the corresponding branch on the branching gear assembly 9. The four-bar linkages of the transfer-tong mechanism 2 are so designed that the coupling curve 73 (FIG. 12), along which the transfer tongs 17 travel on the coupler extension 72 has a horizontal rectilinear portion in which the tongs 17 move slowly radially towards the tube resting on the receiving table 74, the distances between the points marked along the coupling curve 73 representing the distances travelled during equal units of time. This ensures that, without resorting to special measures, for example the allowance of safety periods, the tubes 15 are efficiently transferred from the receiving table 74 by the transfer tongs 17. The receiving table 74 can be swung into a top position, as shown in FIG. 7, about a hinge 75 with the aid of a lifting means 76, so that the passage of a tube 15 into the zone of the transfer tongs 17 is prevented. A further possible arrangement consists in providing, between the crankshafts 62 and their drives, clutches which can be engaged in the branching gear assemblies 7 and 9, so that the transfer tongs 17 can be halted during one revolution. The blocking of the tube feed or the halting of the transfer tongs 17 can be used to cater for breakdowns or may take place after each second cycle of the transport-tong movement if the two shaping faces of one of the dies are to receive one tube only. An adjustable stop 77 is provided for setting the precise position of the tubes 15 on the receiving table 74.

Regarding the perspective diagrammatic illustration of the entire gear arrangement as shown in FIG. 13 and for explaining how the groups of gears cooperate, reference is made to the description associated with the other figures.

Although, in practice, upsetting presses are usually equipped with dies which are provided with two superposed shaping faces, and although the invention has been described in relation to such upsetting presses, it is not limited to these but may also be used for dies having more than two shaping faces superposed at the same distance. In such cases, the conveyor-tong mechanisms 1 are provided with intermediate conveyor tongs 16*m* in a correspondingly larger number (n−1 for n superposed shaping faces), the intermediate conveyor tongs $16m^1$ to $16m^{n-1}$ being vertically superposed and have the same vertical spacing as the shaping faces, and a correspondingly larger number of stationary retaining tongs have to be provided in an otherwise similar form of construction of the loading installation in accordance with the invention.

We claim:

1. Loading equipment for manipulating tubes on upsetting presses having vertically divided dies which are provided with n superposed shaping faces and which are formed by a front pair of jaws for clamping and a rear pair of jaws comprising the upsetting shaping faces, the loading equipment being arranged within a transverse conveyor means for the tubes and comprising means for receiving the tubes to be manipulated, by which means the tubes can be moved axially into and out of the dies and vertically transversely of the tube axes into the shaping faces by a movement-imparting drive, characterised in that the means for receiving the tubes comprise tongs having operating means connected thereto to provide for opening and closing, at least two of which are arranged along the length of the tubes and which are superposed in sets of (n+1) in a vertical plane at the same vertical spacing as the shaping faces and are displaceable simultaneously and unidirectionally transversely of the axes of the tubes in a closed path, and the highest and lowest points of the path lie vertically one above the other at a distance corresponding to that separating the shaping faces in the dies, the movement-imparting drive comprising means for briefly interrupting the movement cycle each time the highest and lowest points of the path are reached, and the lower dwell position of the upper tongs having an axial tube position congruous with a tube clamped in the upper shaping face of each die;

in that the upper and lower of the (n+1) tongs are furthermore displaceable opposite each other at right angles to the said path forming a normal plane, the displacement being towards and away from the dies over distances greater than the axial length of the dies; and in that the operating means appropriately opens and closes the tongs during the upwardly and downwardly directed parts of the movement cycle.

2. In a tube-upsetting plant comprising a vertically divided upsetting die provided with a plurality n of vertically spaced shaping faces, feeding means for moving successive tubes longitudinally into and out of the die and vertically, transversely to the tube axes, into alignment with successive shaping faces, which feeding means comprise:

(a) a plurality of sets of tube tansport grippers which sets are spaced longitudinally of the tubes and in which each set comprises a plurality (n+1) of the tube grippers spaced axially of the die and vertically at a spacing equal to the vertical spacing of the shaping faces of the die;

(b) first drive means for moving said sets of grippers unidirectionally along a closed path transverse to the axes of the tubes, said drive means providing an upper dwell position and a lower dwell position along said path and vertically spaced at a spacing equal to that of said shaping faces, a first one of said dwell positions being so disposed that in said position a first extreme one of said grippers if axially aligned with a first extreme one of said shaping faces of the die;

(c) second drive means for moving the uppermost and lowest grippers in opposite direction to one another towards and away from the die perpendicularly to the said path over a distance greater than the axial length of the die for inserting tubes into and withdrawing tubes from the extreme shaping faces of the die respectively;

(d) and operating means for opening said extreme one of said grippers on movement thereof from said first dwell position to the other said dwell position and for closing said other grippers on movement thereof from said other dwell position to said first dwell position;

(e) the said first and second drive means being synchronised whereby in operation in the said other dwell position the first extreme gripper is open and in an axial position retracted from the die for receiving a tube to be upset and the other extreme one of the grippers is open and in an axial position advanced towards and axially aligned with the other extreme one of the shaping faces of the die for gripping an upset tube to be withdrawn, and in the said first dwell position the first extreme gripper is in an axial position advanced towards and axially aligned with the said first extreme shaping face of the die for locating therein the tube to be upset and the other extreme gripper is axially withdrawn from the die, whereas the gripper(s) intermediate between the said extreme grippers are operative to transfer tubes successively from each said shaping face to the next following shaping face.

3. Feeding means according to claim 2 in which the first drive means are adapted to generate said path substantially in the form of a square having vertical sides which correspond to the vertical spacing between the shaping faces in the die, and horizontal upper and lower sides, the upper and lower dwell positions being at the middles of the horizontal upper and lower portions of the path.

4. Feeding means as in claim 3 further comprising at least one lifting beam on which the grippers are mounted, and in which the first drive means comprise two wheel-crank drives each consisting of a rotatable main crank, an auxiliary crank mounted rotatably on the main crank with parallel laterally offset axes, and gearing constraining the auxiliary crank to rotate at four times the rate of rotation of the main crank, the auxiliary crank having a radius of approximately one half the arc height of a quarter-circle segment of the rotation circle described by the axis of rotation of the auxiliary crank on rotation of the main crank, whereby on rotation of the main crank the auxiliary crank will move in a substantially square path, the auxiliary cranks being coupled by the lifting beam to form a parallel-motion linkage for moving the gripper along said closed path parallel to the path of the auxiliary cranks.

5. Feeding means as in claim 3 further including tube transfer grippers for transferring tubes laterally into position for engagement by the tube transport grippers, pivoted arms carrying said transfer grippers, a tube table to one side of the die, and third drive means for oscillating said arms between a tube pickup position at said table and a tube release position axially aligned with the said first extreme gripper when the latter is in its said other dwell position for transferring tubes successively from said table to said first extreme gripper, operation of said third drive means being synchronised with said first drive means.

6. Feeding means as in claim 5 in which the third drive means comprises a four-bar linkage for each pivoted arm consisting of a driving rocker arm pivotally mounted on a housing means, a follower rocker arm pivotally mounted on a bracket on the housing means and on said driving rock arm, one of said pivoted arms which is connected between the bracket and driving rocker arm, and a coupler link formed by the bracket mount and the rocker arm mount, the transfer grippers being mounted on extensions of the pivoted arms.

7. Feeding means as in claim 6 in which the said four-bar linkage has proportions selected to generate a slow substantially rectilinear motion of said transfer gripper adjacent to the tube pickup position.

8. Feeding means as in claim 6 comprising a further four-bar linkage consisting of a driving crank journalled in the housing means, a coupler link articulated thereto, a fixed link comprising the housing section between the crank journal and the rocker arm mount, and a driven rocker arm articulated to the coupler link, the said driven rocker arm being fast with the said driving rocker arm for rocking the latter.

9. Feeding means as in claim 2 further including upper and lower slides respectively carrying the uppermost and lowest tube transport grippers for sliding axially towards and away from the die at right angles to the said closed path, and a common support for said slides, in driven relation with the first drive means, and in which the second drive means comprises respective counter-moving driving elements for said slides and a common drive input thereto comprising a rockable sector coupled to said driving elements and a crank drive coupled to said sector and having a selectively adjustable stroke and selectively adjustable reversal points.

10. Feeding means as in claim 2 further including a variable-speed transmission and an intermittent-motion transmission driven thereby, the said drive means being driven from the intermittent-motion transmission for providing said dwell positions.

11. Feeding means as in claim 2 further including a variable-speed transmission and an intermittent-motion transmission driven thereby, the said drive means being driven from the intermittent-motion transmission for providing said dwell positions, and in which the intermittent-motion transmission comprises an input main crank, an auxiliary crank mounted eccentrically for rotation on the main crank, gearing constraining the auxiliary crank to rotate at twice the rate of rotation of the main crank, the auxiliary crank having a crank pin having a roller offset approximately one third the distance between the main crank and the auxiliary crank, and an output drag arm rotatable about the axis coaxial with the main crank and engaged with the auxiliary crank.

12. Feeding means as in claim 2 further including a variable-speed transmission and an intermittent-motion transmission driven thereby, the said drive means being driven from the intermittent-motion transmission for providing said dwell positions, and a drive-distributing transmission with a 1:1 transmission ratio connected between the intermittent motion transmission and the said drive means and having respective power take-offs for the respective drive means.

13. Feeding means according to claim 1, characterised in that there are provided, in association with the tube transport grippers, stationary retaining grippers, at least two in number spaced along the length of the tubes, which are aligned with respective shaping faces of the die for receiving the tubes from the said transport grippers and holding the tubes during upsetting.

* * * * *